US005947101A

United States Patent [19]

Kerr

[11] Patent Number: 5,947,101

[45] Date of Patent: Sep. 7, 1999

[54] SKEET THROWING DEVICE

[75] Inventor: Charles E. Kerr, Hillsboro, Oreg.

[73] Assignee: The Jugs Company, Tualatin, Oreg.

[21] Appl. No.: 09/045,191

[22] Filed: Mar. 20, 1998

[51] Int. Cl.[6] ..... F41J 9/18; F41B 4/00

[52] U.S. Cl. ..... 124/78

[58] Field of Search ..... 124/6, 78

[56] References Cited

U.S. PATENT DOCUMENTS

| | | | |
|---|---|---|---|
| 4,747,390 | 5/1988 | Storm | 124/6 |
| 4,922,885 | 5/1990 | Iwabuchi et al. | 124/78 |
| 5,125,653 | 6/1992 | Kovacs et al. | 124/78 |
| 5,611,322 | 3/1997 | Matsuzaki et al. | 124/6 |
| 5,782,228 | 7/1998 | Wu | 124/6 |

FOREIGN PATENT DOCUMENTS

| | | | |
|---|---|---|---|
| 12935 | 1/1988 | Japan | 124/78 |

*Primary Examiner*—John A. Ricci
*Attorney, Agent, or Firm*—Olson & Olson

[57] ABSTRACT

A skeet throwing device includes a frame mounting a pair of rotary wheels spaced apart a distance less than the diameter of a skeet member which is delivered to the wheels by a carriage movable toward and away from the wheels; either manually or by an extensible fluid pressure cylinder. In a powered arrangement, a skeet support adjacent the carriage supports a vertical stack of skeet members, and a skeet pusher on the carriage is disposed to engage the bottommost skeet member of the stack and move it forwardly from under the stack. A skeet guide on the skeet support guides the bottommost skeet member forwardly and laterally from the skeet support onto the carriage for delivery to the rotary wheels. An auxiliary skeet stack support on the skeet pusher supports the stack above the bottommost skeet member temporarily while the skeet pusher moves forwardly to deliver the bottommost skeet member to the rotary wheels and while the pusher retracts to deposit the stack back onto the stack support, preparatory to delivering the next succeeding bottommost skeet member to the rotary wheels. A skeet hold down tongue projects forwardly of the skeet pusher for overlying a skeet member being pushed toward the rotary wheels, to stabilize the skeet member as it is engaged by the rotary wheels.

13 Claims, 5 Drawing Sheets

SKEET THROWING DEVICE

BACKGROUND OF THE INVENTION

This invention relates to trapshooting, and more particularly to a novel device for throwing clay pigeons, or skeet, for trapshooting.

Trapshooting mechanisms provided heretofore are of two basic types. The first type, exemplified by U.S. Pat. No. 3,537,438 is a hand-operated, elongated arm that is held at one end in the hand of an operator and which supports a frangible skeet releasably at the opposite end of the arm, the arm being whirled about the body of the operator and the skeet released after reaching desired rotational speed. The second type, exemplified by U.S. Pat. No. 3,971,357 is a spring-loaded elongated arm that releasably supports a skeet at its outer end and is preset at a spring-tensioned position of rotation for trigger release, whereupon the pre-set arm is rotated rapidly by uncoiling of the spring, to project the skeet from the arm. Both types of mechanisms are unable to achieve reproducibility of selected speeds of projection of skeet and of accuracy and predictability of direction of projection of skeet.

SUMMARY OF THE INVENTION

The skeet throwing device of this invention utilizes a pair of rotating wheels to grasp a skeet between them and fling it from between the wheels at selected speeds and directions.

It is the principal objective of this invention to provide a skeet throwing device of the class described that overcomes the aforementioned limitations and disadvantages of prior art skeet throwers.

Another objective of this invention is the provision of a skeet throwing device of the class described which allows skeet to be thrown at any speed within a selected range and at any horizontal or vertical angle relative to the device.

Still another objective of this invention is to provide a skeet throwing device of the class described which allows skeet to be thrown on straight or curved paths.

A further objective of this invention is to provide a skeet throwing device of the class described which is of simplified construction for economical manufacture, maintenance and repair.

The foregoing and other objects and advantages of this invention will appear from the following detailed description, taken in connection with the accompanying drawings of preferred embodiments.

DESCRIPTION OF THE PREFERRED EMBODIMENTS

Figure 8:
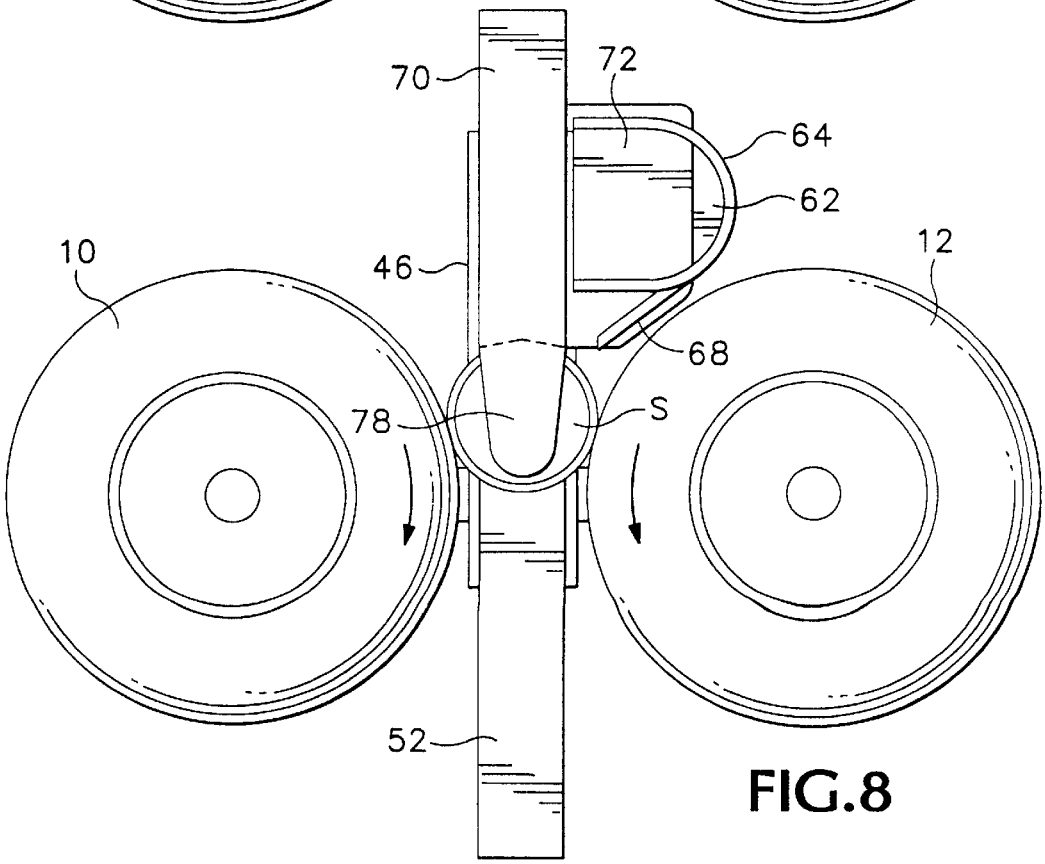
FIG. 8 is a plan view similar to FIG. 7, showing the skeet delivery assembly in fully advanced position of delivery of a skeet to the rotary projection wheels.

In the embodiment illustrated in FIGS. 1–8, a pair of pneumatic tires 10 and 12, mounted on wheels 14 and 16, respectively, are spaced apart laterally so that the minimum distance between the confronting, skeet gripping surfaces of the tires is slightly less than the maximum diameter of a skeet S (FIG. 8). The wheels are driven, one clockwise and the other counterclockwise (FIG. 6), so that the confronting surfaces move simultaneously in the same direction, i.e. in a forward, skeet throwing direction.

The rotary wheel assembly is mounted on a frame 18 provided at its opposite ends with downturned flanges 20, 22. An electric drive motor 24 is secured to flange 20, and an elongated flexible cable 26 couples the electric motor to a shaft 28 mounted in bearings 30 secured to the other flange 22 of the frame 18.

The use of a single drive motor and flexible cable not only minimizes cost of manufacture, but it also insures rotation of both wheels at the same speed. The drive motor is of the variable speed type which is adjustable by means of a control 32 mounted conveniently on the housing of motor 24.

A turntable 34 is secured to the frame 18 centrally between the flanges 20, 22 and is provided with an axial bore for reception of a cylindrical turntable post 36 projecting upward from a tripod base 38 to which are removably attached the upper ends of three elongated legs 40 arranged to form a tripod support. In the embodiment illustrated, one of the legs is provided with a telescopic leg section 42 which is adjustable longitudinally relative to its associated leg 40, to effect adjustment of the plane through the rotary wheels to provide various degrees of vertical trajectories. A setscrew 44 releasably secures the telescopic leg section 42 in desired position of adjustment.

A carriage support 46 is secured to the frame 18, as by bolts, welding, etc. and extends rearwardly relative to the rotary wheels. The carriage support is C-shaped in cross section and provided with inturned guide flanges 48 for slidable reception in the side grooves 50 of an elongated carriage 52. An elongated fluid pressure cylinder 54 is connected at one end pivotally to the carriage support 46, by pivot pin 56 and an associated piston rod 58 is connected at its outer end to the carriage 52 by pivot pin 60. Thus, by application of fluid pressure to opposite ends of the cylinder, the piston rod is extended and retracted relative to the cylinder, to effect reciprocation of the carriage 52 on the carriage support 46.

A skeet support platform 62 is mounted on the carriage support 46 and is provided with an arcuate upstanding container wall 64 of U-shape which is spaced upwardly from the platform by means of the downwardly extending wall section 64'. The space between the platform and bottom end 66 of the container wall is slightly greater than the thickness of a skeet member S, to allow passage through said space. As shown in the drawings, the skeet member S is a flat disc having a circular periphery.

Extending forwardly from the wall section 64' and angularly toward the carriage 52 is a skeet feed guide 68 which functions in the manner described hereinafter to move a skeet laterally onto the carriage.

Mounted on the carriage 52 is a skeet pusher block 70. Extending laterally from the pusher block is an auxiliary skeet supporting tray 72. The front end of the block and tray form a skeet abutting edge 74 (FIG. 6), for moving a skeet S from the platform 62 onto the carriage 52. A slot 76 in the wall 64 rearwardly of wall section 64' is arranged to receive the tray 72 during its forward movement. A forwardly extending hold down tongue 78 extends from the edge 74 of the pusher block and is arranged to overlie a skeet S supported on the carriage as the skeet is delivered to the rotary wheels.

Figure 1:
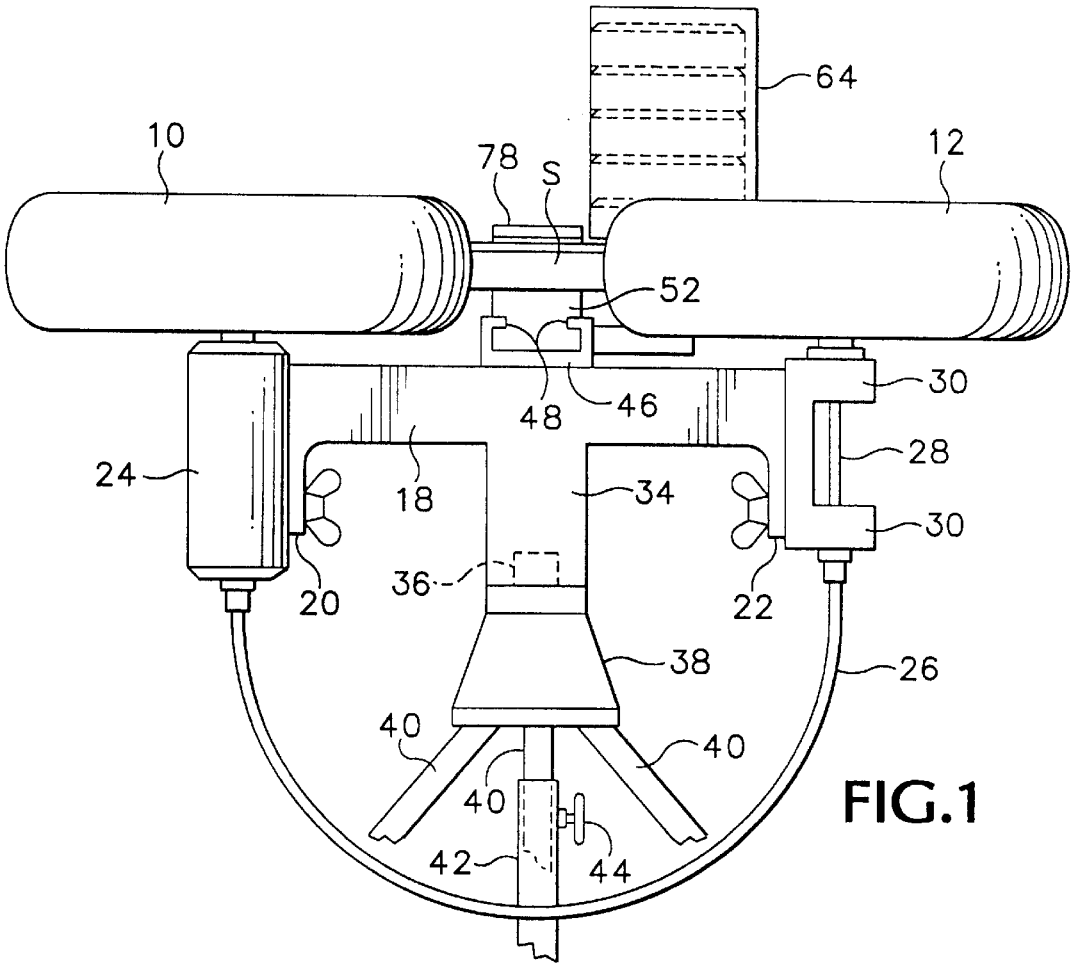
FIG. 1 is a fragmentary front elevation of a skeet throwing device embodying the features of this invention.
Figure 2:
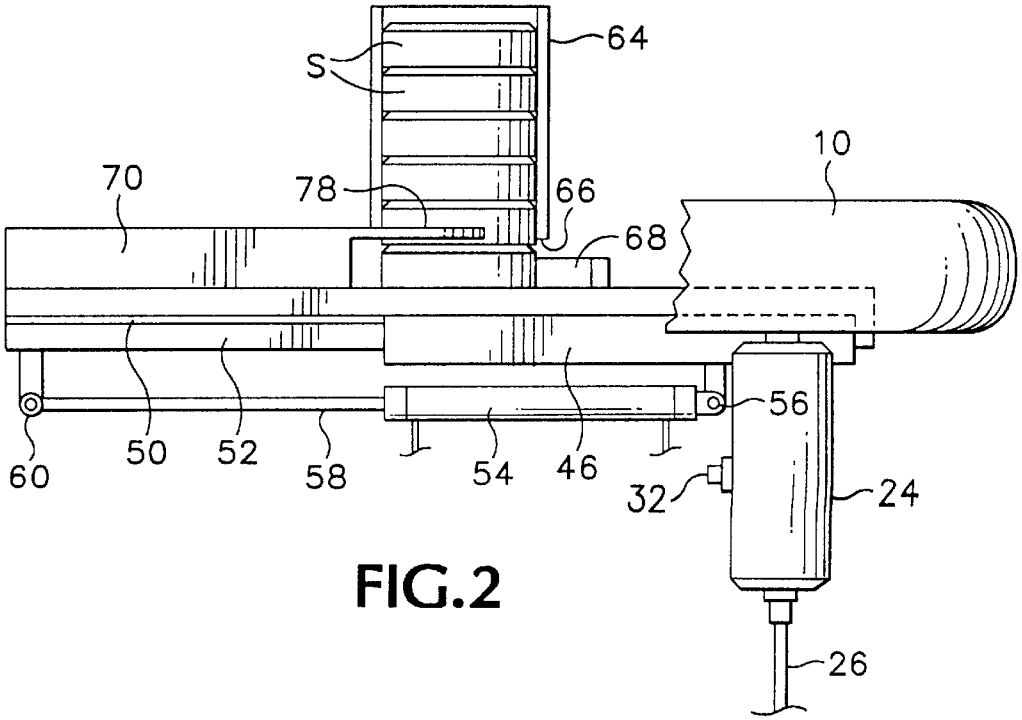
FIG. 2 is a fragmentary side elevation as viewed from the left in FIG. 1.
Figure 3:
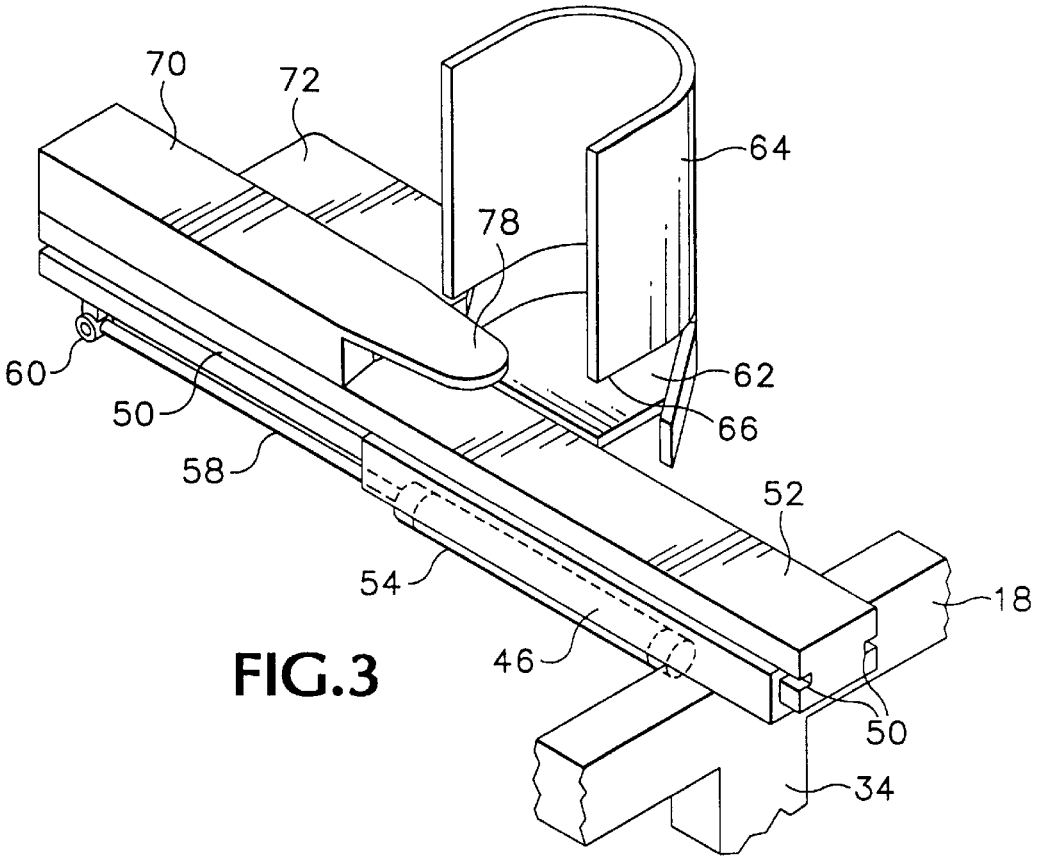
FIG. 3 is a fragmentary perspective view of the skeet delivery system of the device of FIG. 1, viewed from the right front, the delivery system being shown in fully retracted position.
Figure 4:
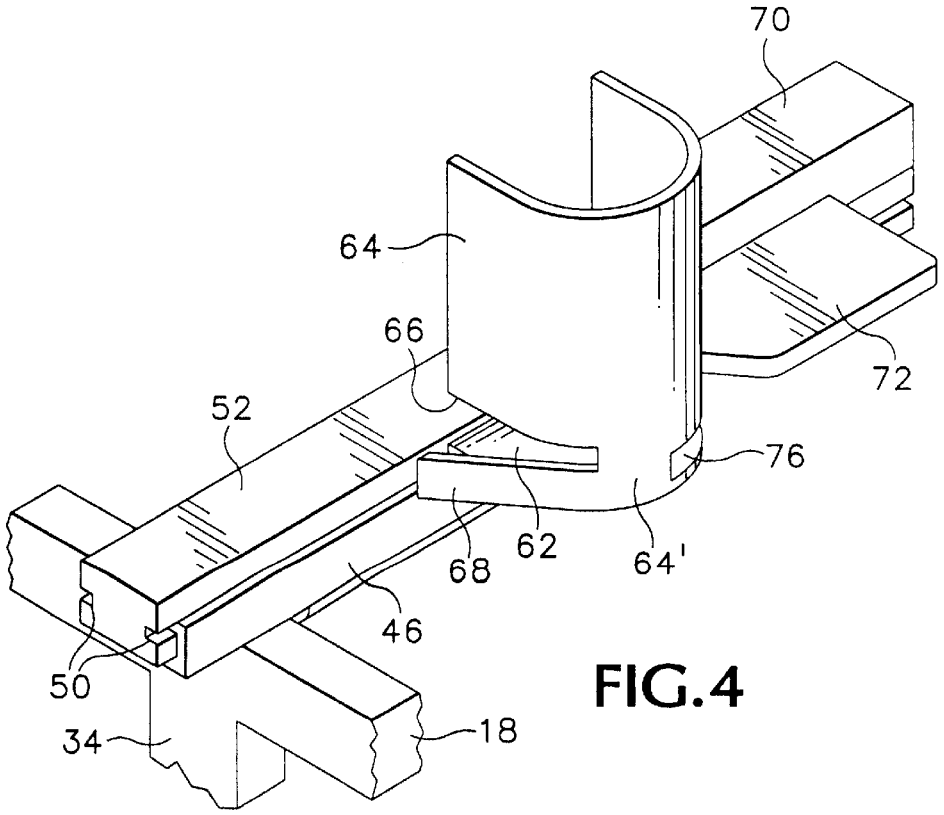
FIG. 4 is a fragmentary perspective view of the skeet delivery assembly of FIG. 3, as viewed from the left front.
Figure 5:
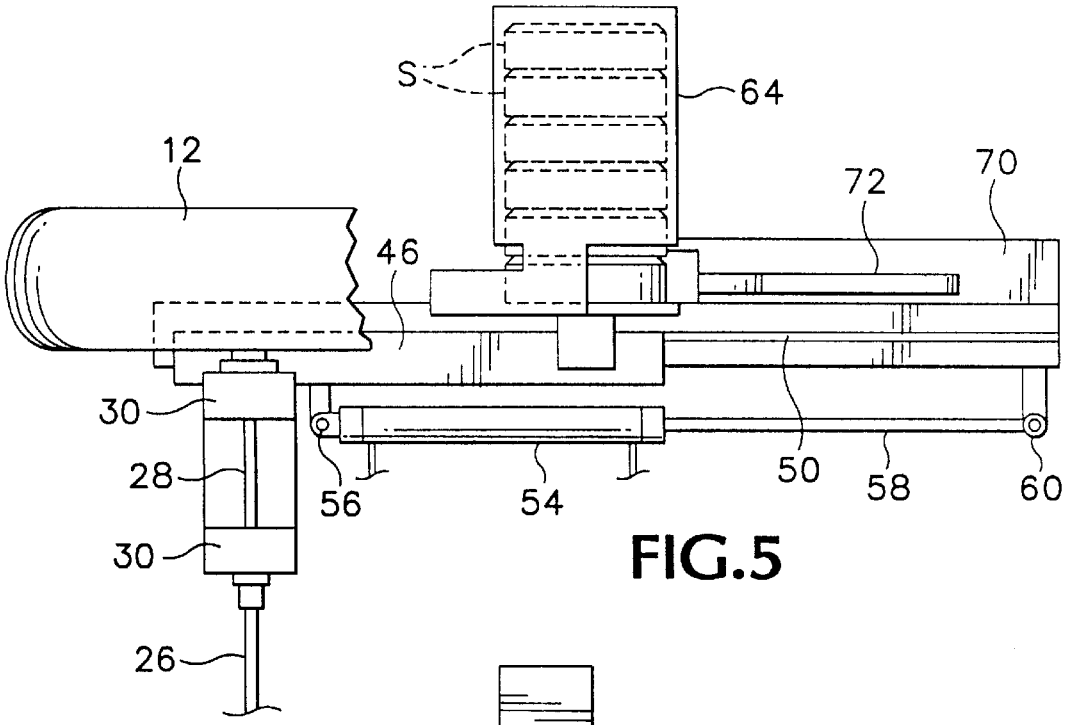
FIG. 5 is a fragmentary side elevation as viewed from the right in FIG. 1.
Figure 6:
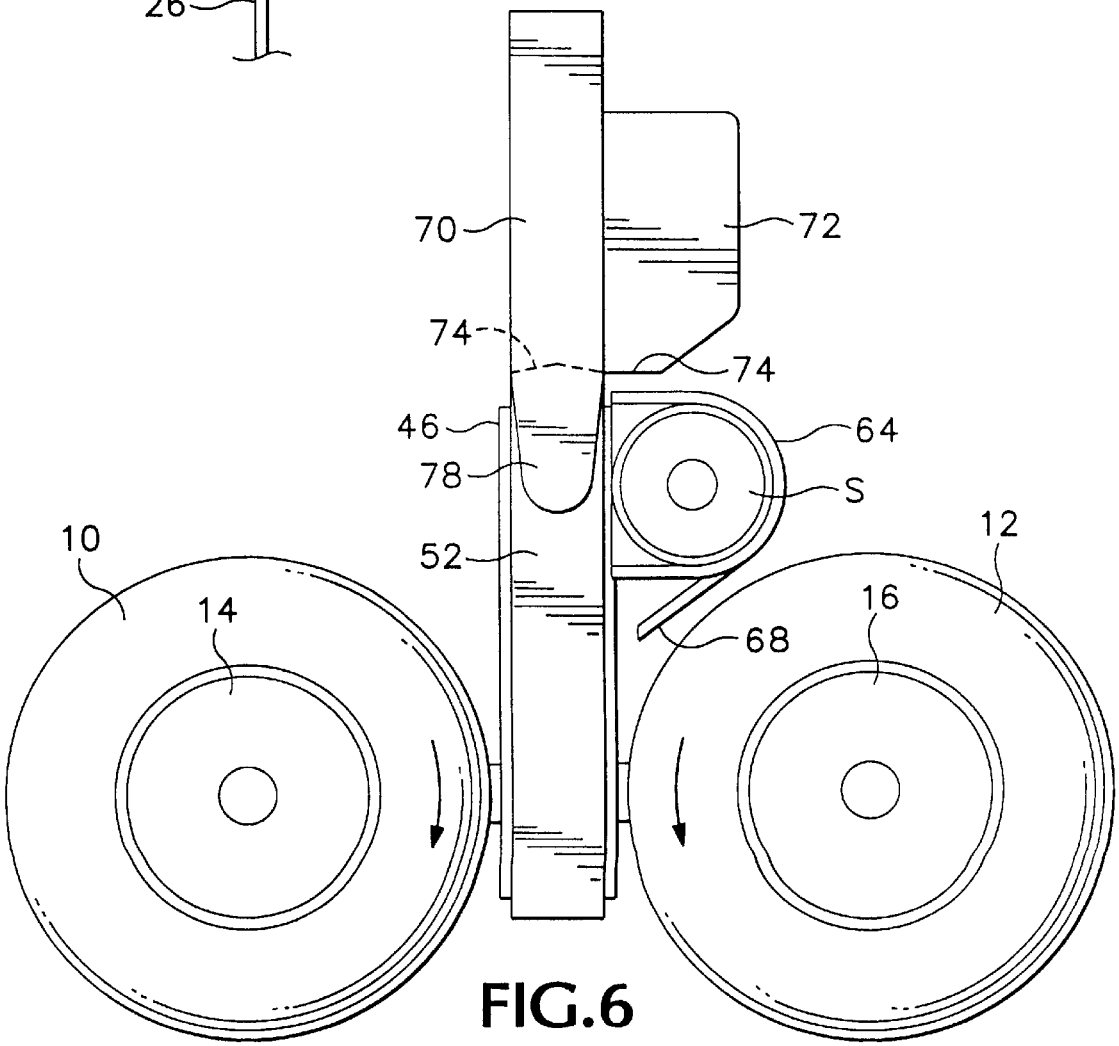
FIG. 6 is a plan view as viewed from the top in FIG. 1, the skeet delivery assembly being shown in fully retracted position.
Figure 7:
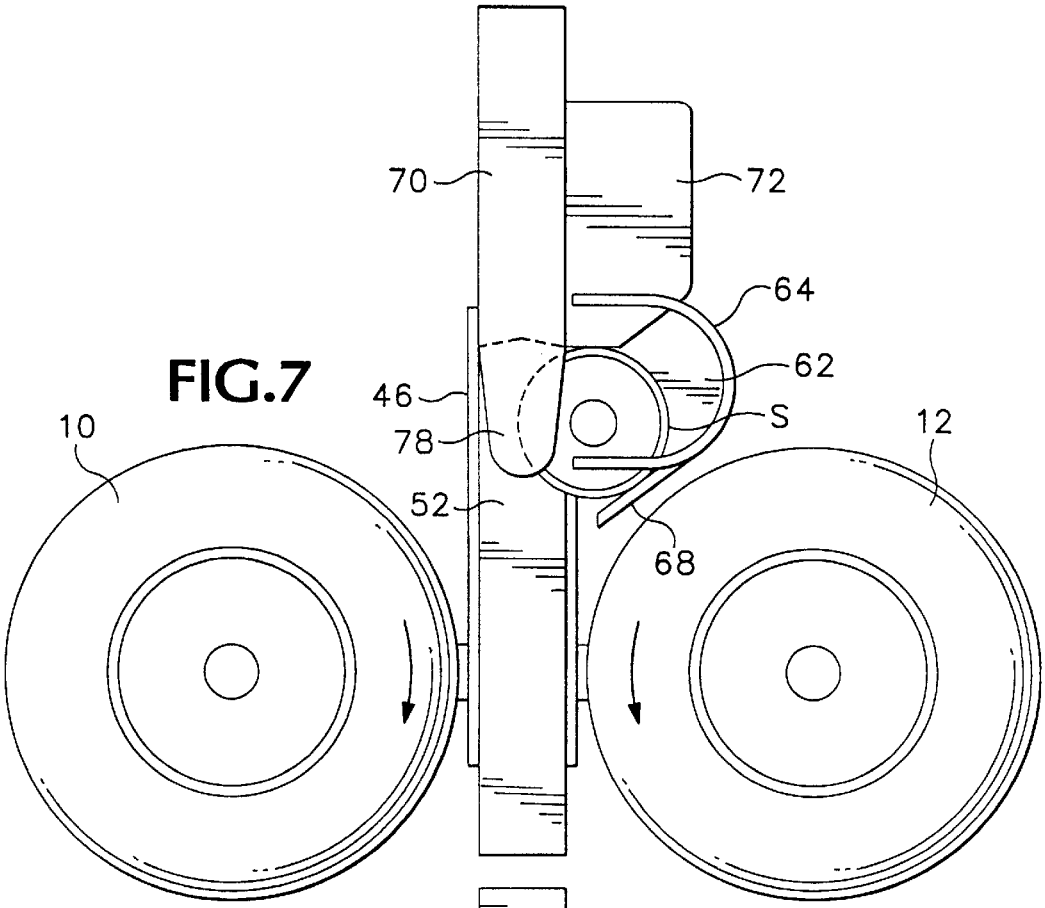
FIG. 7 is a plan view similar to FIG. 6, showing the skeet delivery system in an intermediate position of skeet delivery to the rotary projection wheels.

The operation of the skeet throwing device described hereinbefore is as follows:

With the carriage 52 retracted to the position illustrated in FIG. 6, a plurality of skeet members S is mounted in a vertical stack on the platform 62 within the confining wall 64. The electric motor 24 is energized to effect rotation of the pair of wheels 14 and 16 in the direction of the arrows and at a rate of speed determined to project a skeet at a desired speed. The telescopic leg section 42 is adjusted to provide the desired trajectory of flight of the skeet member. Fluid pressure then is applied to the cylinder to retract the piston rod within it, thereby moving the carriage 52 toward the rotating wheels.

As the carriage moves forward, the front edge of the tray 72 moves forward through the slot 76 and engages the bottommost skeet of the stack supported on the platform 62. Continued forward movement of the carriage results in the bottommost skeet being moved forward through the slot 66 and angularly toward the carriage 52 by guidance of the feed guide 68.

Further forward movement of the carriage moves the tray 72 under the skeet adjacent the bottommost skeet that has been moved forward, whereby the tray serves as an auxiliary support for the stack while the bottommost skeet is moved forward to the rotating wheels.

The carriage 52 continues to move forward to the end of its forward stroke, determined by retraction of the piston rod within the cylinder, at which point the circular periphery of the flat skeet carried on the carriage engages the mutually confronting gripping surfaces of the tires 10 and 12. Thereupon the skeet is propelled forward through the space between the rotating wheels, at the speed determined by the rotating wheels and on the trajectory determined by the vertical tilt of the plane of the rotating wheels.

The trajectory of flight of the skeet may be changed simply by adjustment of the telescopic leg section 42. The direction of horizontal projection of the skeet also may be changed simply by rotating the wheel assembly on the turntable 34 about the axis of the post 36. Suitable clamping mechanism may be provided for securing the turntable in adjusted position. A suitable clamping mechanism for this purpose may be the clamping mechanism disclosed in commonly owned U.S. Pat. No. 4,026,261.

Figure 9:
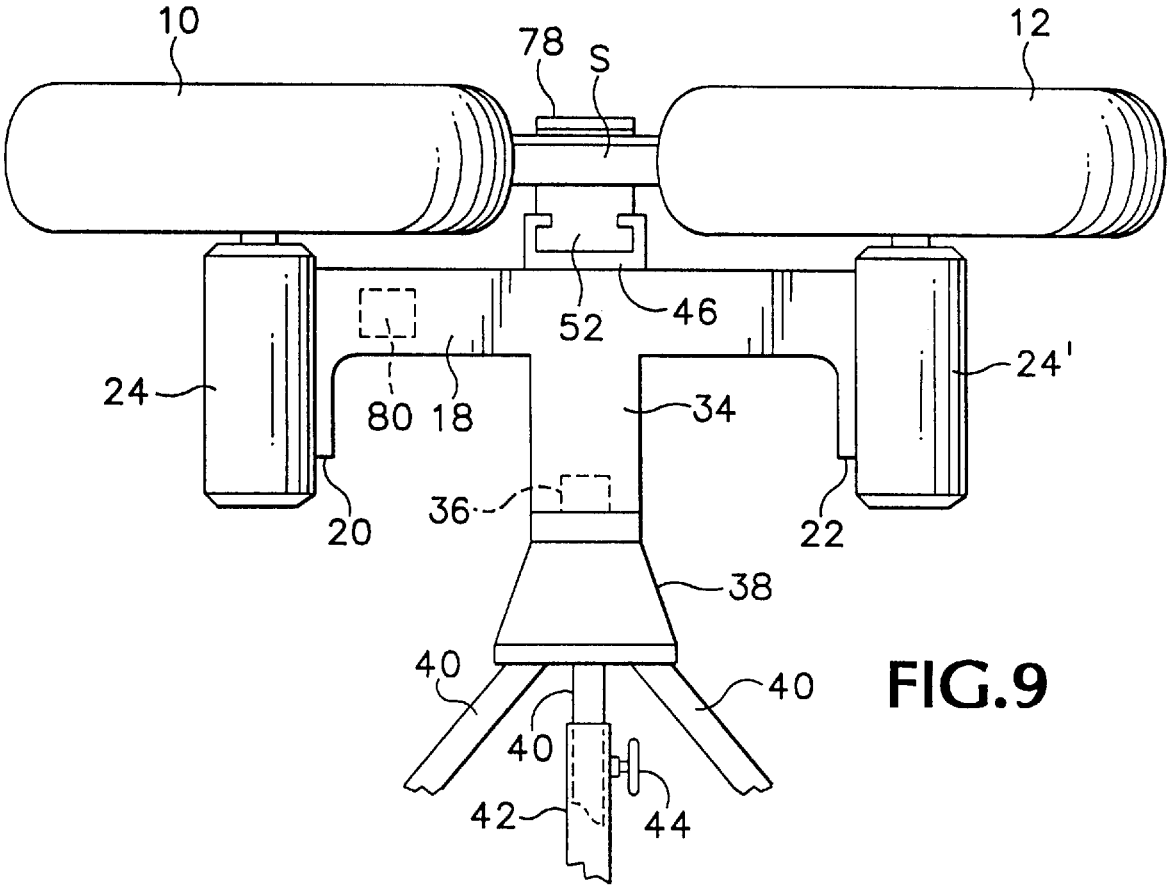
FIG. 9 is a fragmentary front elevation of a second embodiment of a skeet throwing device embodying the features of this invention.
Figure 10:
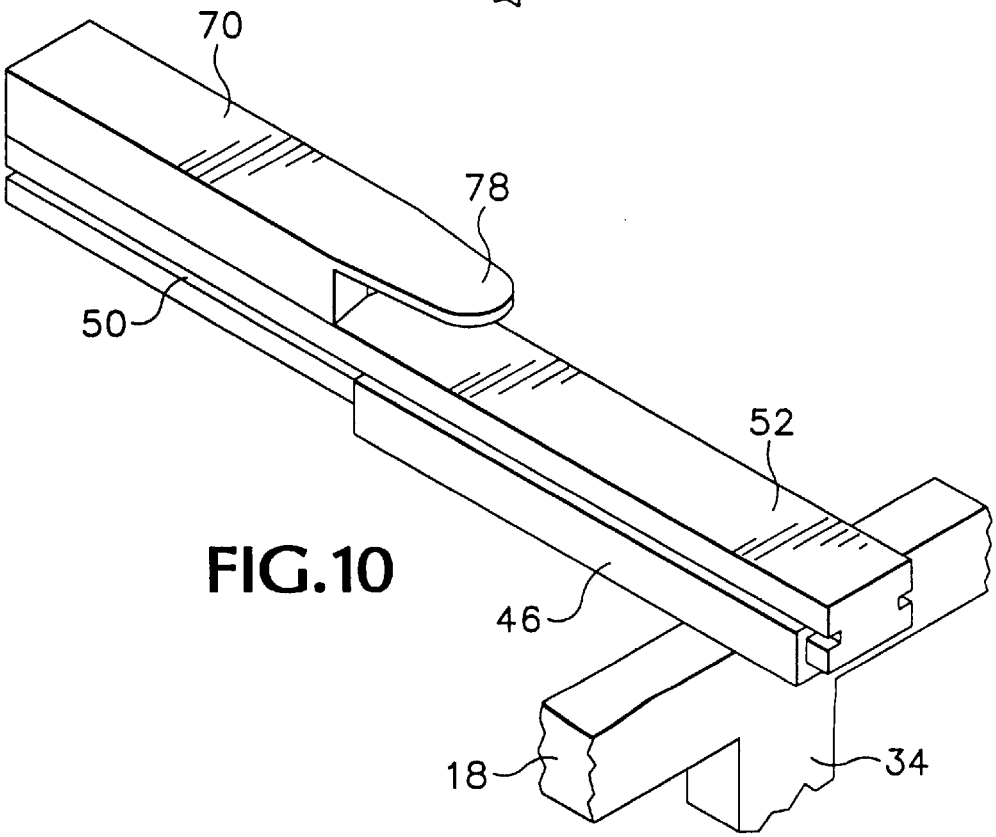
FIG. 10 is a fragmentary perspective view of the skeet delivery system of the device of FIG. 9.

FIGS. 9 and 10 show a second embodiment of skeet throwing device of this invention. It is a simplified version of the embodiment first described, designed for manual delivery of skeet, one at a time, to the rotary tires 10 and 12. Thus, the fluid pressure cylinder 54 and piston rod 58, the platforms 62, wall 64 and tray 72 are omitted.

This second embodiment also illustrates the use of two variable speed electric motors 24 and 24' for rotating the wheels 14 and 16, respectively, independently of each other. An electrical control 80, mounted on frame 18, serves to adjust the speed of each motor separately, to effect rotation of one wheel at a speed different from the other wheel. This mode of operation effects axial rotation of a skeet S in one direction or the other, to project the skeet on a curved path and thereby confront the trapshooter with a further directional factor.

The second embodiment is operated by manually depositing a skeet on the carriage 52 under the hold down tongue 78 and then pushing the carriage forwardly relative to carriage support 46, to bring the skeet into engagement with the rotating tires, the carriage is retracted manually in preparation for a subsequent delivery cycle.

It will be apparent to those skilled in the art that various changes may be made in the size, shape, type, number and arrangement of parts described hereinbefore. For example, actuation of the cylinder 54 may be done by remote control, as by the trapshooter from his station, by any well-known electrical control switch mechanism. Means other than the telescopic leg arrangement may be provided for varying the vertical trajectory of the skeet, such as the pivot and clamp arrangement illustrated in the U.S. Pat. No. 4,026,261 previously mentioned. The wheels 14 and 16 may be replaced with a pair of endless belts mounted on spaced sprockets or other forms of wheels. The foregoing and other changes may be made, as desired, without departing from the spirit of this invention and the scope of the appended claims.

I claim:

1. A skeet throwing device for a disc-shaped skeet member having a circular periphery, comprising:

a) a frame, b) a pair of rotatable members on the frame having mutually confronting skeet gripping surfaces spaced apart laterally a distance slightly less than the diameter of a skeet member to be thrown, c) drive means engaging the rotatable members for rotating said mutually confronting surfaces simultaneously in a forward, skeet projecting direction, and d) infeed means on the frame for supporting and delivering a disc-shaped skeet member flatwise into engagement of its circular periphery with said mutually confronting surfaces to effect projecting the skeet member forwardly therefrom, said infeed means including a carriage on the frame movable toward and away from the rotatable members for delivering a skeet member forwardly into engagement with said mutually confronting surfaces of the rotatable members.

2. The skeet throwing device of claim 1 including means on the frame for adjusting the forward inclination of the rotatable members for varying the vertical angle of projection of a skeet member forwardly of the rotatable members.

3. The skeet throwing device of claim 1 including means on the frame for adjusting the horizontal direction of projection of a skeet member.

4. The skeet throwing device of claim 1 including means associated with the drive means for varying the rotational speed of the rotatable members for varying the speed and distance of projection of a skeet member.

5. The skeet throwing device of claim 1 including means associated with the drive means for changing the speed of one rotatable member relative to the other rotatable member for inducing axial rotation of a skeet member.

6. The skeet throwing device of claim 1 including a skeet support on the frame adjacent the carriage for supporting a vertical stack of skeet members for delivery one skeet member at a time to the carriage.

7. The skeet throwing device of claim 6 including a guide member on the skeet support for guiding a skeet member from the skeet support laterally and forwardly onto the carriage during forward movement of the carriage.

8. The skeet throwing device of claim 6 including skeet support means movable with the carriage for slidably supporting a stack of skeet members above the skeet support temporarily during delivery of the bottommost skeet member from the stack forwardly to the rotatable members and during retraction of the carriage for deposit of the stack back to the skeet support.

9. The skeet throwing device of claim 1 including skeet hold down means on the carriage for overlying a skeet member on the carriage while delivery to the rotating wheels.

10. The skeet throwing device of claim 1 including extensible fluid pressure drive means interengaging the frame and carriage for moving the carriage toward and away from the rotatable members.

11. The skeet throwing device of claim 1 wherein the rotatable members are wheels provided with skeet gripping surfaces.

12. The skeet throwing device of claim 1 including:

a) means on the frame for adjusting the forward inclination of the rotatable members for varying the vertical angle of projection of a skeet member forwardly of the rotatable members, b) means on the frame for adjusting the horizontal direction of projection of a skeet member forwardly of the rotatable members, and c) means associated with the drive means for varying the rotational speed of the rotational members for varying the speed and distance of projection of a skeet member.

13. The skeet throwing device of claim 12 including:

a) a skeet support on the frame adjacent the carriage for supporting a vertical stack of skeet members for delivery one skeet member at a time to the carriage, b) a guide member on the skeet support for guiding a skeet member from the skeet support laterally and forwardly onto the carriage during forward movement of the carriage, c) skeet support means movable with the carriage for slidably supporting a stack of skeet members above the skeet support temporarily during delivery of the bottommost skeet member from the stack forwardly to the rotatable members and during retraction of the carriage for deposit of the stack back to the skeet support, and d) skeet hold down means on the carriage for overlying a skeet member on the carriage during delivery to the rotating members.

* * * * *